US007520032B2

(12) United States Patent
Kousaka et al.

(10) Patent No.: US 7,520,032 B2
(45) Date of Patent: Apr. 21, 2009

(54) LINEAR SLIDE FASTENER

(75) Inventors: Yoshihiro Kousaka, Toyama-ken (JP); Sotoji Yonishi, Toyama-ken (JP); Takumi Arai, Toyama-ken (JP)

(73) Assignee: YKK Corporation, Tokyo (JP)

( * ) Notice: Subject to any disclaimer, the term of this patent is extended or adjusted under 35 U.S.C. 154(b) by 18 days.

(21) Appl. No.: 11/373,741

(22) Filed: Mar. 10, 2006

(65) Prior Publication Data

US 2006/0200950 A1 Sep. 14, 2006

(30) Foreign Application Priority Data

Mar. 14, 2005 (JP) ..... 2005-071450

(51) Int. Cl.
*A44B 19/24* (2006.01)

(52) U.S. Cl. ..... 24/395; 24/394

(58) Field of Classification Search ..... 63/395
See application file for complete search history.

(56) References Cited

U.S. PATENT DOCUMENTS

| | | | | |
|---|---|---|---|---|
| 3,149,388 A | | 9/1964 | Wilcken | |
| 3,579,748 A | | 5/1971 | Chery | |
| 3,629,911 A | | 12/1971 | Porepp | |
| 3,820,202 A | * | 6/1974 | Takamatsu | 24/393 |
| 3,908,242 A | * | 9/1975 | Reynolds | 24/395 |
| 4,060,886 A | | 12/1977 | Moertel | |
| 4,205,027 A | | 5/1980 | Heimberger | |
| 4,321,733 A | * | 3/1982 | Yoshida | 24/393 |

FOREIGN PATENT DOCUMENTS

| | | |
|---|---|---|
| EP | 1 072 209 | 1/2001 |
| GB | 1 386 496 | 3/1975 |

* cited by examiner

*Primary Examiner*—Jack W. Lavinder
(74) *Attorney, Agent, or Firm*—Alston & Bird LLP

(57) ABSTRACT

The invention provides a linear slide fastener wherein a concave portion accommodating a fixing thread for fixing a fastener tape is provided on a top face of an upper leg portion of a coil-like/zigzag-like linear fastener element, when dimensions from a bottom face of a lower leg portion to a top face of the upper leg portion on a coupling head side, at the concave portion and on an inverted portion side are assumed to be H1, H2 and H3, a setting condition of H1>H3>H2 is satisfied and when dimensions from a bottom face of the upper leg portion to a top face of the lower leg portion within a gap portion on the coupling head side, at a convex portion and on the inverted portion side are assumed to be H4, H5 and H6 respectively, a setting condition of H4>H6>H5 is satisfied.

5 Claims, 9 Drawing Sheets

LINEAR SLIDE FASTENER

BACKGROUND OF THE INVENTION

1. Field of the Invention

The present invention relates to a linear slide fastener in which thermoplastic resin monofilament is formed into a coil-like or zigzag-like linear fastener element having a particular shape and this linear fastener element is attached to a side edge of a fastener tape with a fixing thread such as various types of sewing threads.

2. Description of the Related Art

In a coil-like fastener element 102 of a conventional linear slide fastener disclosed by U.S. Pat. No. 3,149,388, when the coil-like fastener element 102 is sewed by a sewing-machine on a side edge of a fastener tape 104 with a sewing thread 106, a concave portion 114 is formed in a central portion of an upper leg portion 112 of the coil-like fastener element 102 in order to protect the sewing thread 106 from being damaged by sliding a slider and the sewing thread 106 is accommodated in this concave portion 114 for protection as shown in FIG. 12. In this coil-like fastener element 102, a coupling head 110 and an inverted portion 111 of the fastener element 102 are formed in an equal height so as to protect the sewing thread 106.

In the coil-like fastener element 102 shown in FIG. 12, since the coil-like fastener element 102 has the concave portion 114 for accommodating the sewing thread 106 and sizes of portions of the coil-like fastener element 102 on the right and left sides of the concave portion 114, i.e., on a side of the coupling head 110 and on a side of the inverted portion 111, are substantially same, the coil-like fastener element 102 has to be formed larger than actually needed. There is no need to form an inverted portion 111 of the coil-like fastener element 102 so large. Because forming the inverted portion 111 in an equal size to the coupling head 110 leads to forming the coil-like fastener element 102 larger than actually needed, this results in waste of resource and an increase in cost.

SUMMARY OF THE INVENTION

The present invention has been realized in views of the above-described problem and a first object of the invention is to provide a linear slide fastener in which a concave portion for accommodating a fixing thread such as a sewing thread is provided in a coil-like fastener element or zigzag-like fastener element on a side of a coupling head, and an inverted portion is formed in a small size, thereby contributing to reduction in a size of the linear fastener element so as to save resource and achieve a smooth sliding motion of a slider.

In addition to the first object, a second object of the invention is to provided a linear slide fastener in which a convex portion is formed at a top of a gap portion between upper and lower leg portions of the coil-like fastener element or zigzag-like fastener element and by specifying heights of the gap portions on a side of the coupling head, at the convex portion and on a side of the inverted portion, effective engagement of the coupling head is attained and reduction in the size of the linear fastener element is realized.

In addition to the first object, a third object of the invention is to provide a linear slide fastener in which by specifying widths of the surface of the upper leg portion of the coil-like fastener element or zigzag-like fastener element on the side of the coupling head, at the concave portion and on the side of the inverted portion, effective engagement of the coupling head is attained and reduction in the size of the linear fastener element is realized by decreasing the mass of the inverted portion.

In addition to the first object, a fourth object of the invention is to provide a linear slide fastener in which by specifying widths on the side of the coupling head, at the convex portion and on the side of the inverted portion specified in the gap portion between the upper leg portion and lower leg portion of the coil-like fastener element or the zigzag-like fastener element, an inner shape of the linear fastener element is restricted, whereby forming the concave portion on the surface of the linear fastener element and the inverted portion in a smaller size.

In addition to the first object, fifth and sixth objects of the invention are to provide a linear slide fastener in which by specifying a relation between the coupling head and the inverted portion at the concave portion and a gradient of the concave portion formed on a surface of the upper leg portion of the coil-like fastener element or the zigzag-like fastener element, the fixing thread for fixing the linear fastener element is prevented from escaping from the concave portion and reduction in a size securing a smooth engagement and not affecting the engagement condition can be realized.

In addition to the first object, a seventh object of the invention is to provide a linear slide fastener in which the fixing thread for fixing the linear fastener element is protected in a stable condition and further, effective engagement of the coupling head and reduction in the size of the linear fastener element are enhanced by a core thread inserted through the linear fastener element.

According to a first aspect of the invention to achieve the above-described object, in a linear slide fastener in which a coil-like or zigzag-like linear fastener element is fixed on a side edge of a fastener tape with fixing thread such as sewing thread, woven thread, warp knitting yarn, a concave portion for accommodating the fixing thread which is the sewing thread, woven thread or warp knitting yarn is formed on a top face of an upper leg portion of the coil-like or zigzag-like linear fastener element. When heights from a bottom face of the lower leg portion to the top face of the upper leg portion on a side of the coupling head, at the concave portion, and on a side of the inverted portion of the linear fastener element are assumed to be H1, H2 and H3 respectively, the linear slide fastener of the present invention satisfies a setting condition of H1>H3>H2.

According to a second aspect of the invention, in addition to a structure of the first aspect, a convex portion 15 projecting toward a top face of the lower leg portion is formed on a bottom face of the upper leg portion of the coil-like or zigzag-like linear fastener element. When heights between the bottom face of the upper leg portion and the top face of the lower leg portion of the linear fastener element on the side of the coupling head, at the convex portion, and on the side of the inverted portion are assumed to be H4, H5 and H6 respectively, the linear slide fastener of the present invention satisfies a setting condition of H4>H6>H5.

According to a third aspect of the invention, in addition to the structure of the first aspect, when widths on the side of the coupling head, at the concave portion, and on the side of the inverted portion on the top face of the upper leg portion of the coil-like or zigzag-like linear fastener element are assumed to be W1, W2 and W3 respectively, the linear slide fastener of the present invention satisfies a setting condition of W1>W2≧W3.

According to a fourth aspect of the invention, in addition to the structure of the first aspect, when the widths on the side of the coupling head, at the concave portion, and on the side of the inverted portion in a gap portion between the upper leg portion and the lower leg portion of the coil-like or zigzag-like linear fastener element are assumed to be W4, W5 and W6 respectively, the linear slide fastener of the present invention satisfies a setting condition of W5>W4>W6.

According to a fifth aspect of the invention, in addition to the structure of the first aspect, in the concave portion formed on the top face of the upper leg portion of the coil-like or zigzag-like linear fastener element, a width from an end of the coupling head of the linear fastener element on this concave portion to a deepest portion of the concave portion is smaller than a width from an end of the inverted portion on the concave portion to the deepest portion of the concave portion.

According to a sixth aspect of the invention, in addition to the structure of the first aspect, in the concave portion formed on the top face of the upper leg portion of the coil-like or zigzag-like linear fastener element, a depth of the concave portion from an end thereof on the side of the coupling head of the linear fastener element to the deepest portion of the concave portion is larger than a depth of the concave portion from an end thereof on the side of the inverted portion to the deepest portion of the concave portion.

According to a seventh aspect of the invention, in addition to the structure of the first aspect, a core thread acting as a core material is inserted through the gap portion formed between the upper leg portion and the lower leg portion of the coil-like or zigzag-like linear fastener element such that it makes contact with the convex portion formed on the upper leg portion and the inverted portion.

Effects of the present invention will be described below. Due to the first aspect of the invention, the present invention protects the fixing thread as the sewing thread or the woven thread for fixing the linear fastener element from being worn by sliding motion of a slider beforehand thereby protecting the fixing thread completely to provide fastener elements having an excellent sliding performance with engagement motion of the fastener elements kept in a same way as a conventional product. The winding mass of the inverted portion of the fastener element can be reduced to form an entire fastener element in a small size, thereby resulting in saving resources.

According to the second aspect of the invention, in addition to the effect of the first aspect, the gap portion between the upper leg portion and the lower leg portion of the linear fastener element on the side of the coupling head, at the concave portion and on the side of the inverted portion are formed in ideal space thereby contributing to firm engagement of the fastener elements and reduction in the size of the fastener element.

According to the third aspect of the invention, in addition to the effect of the first aspect, the coupling heads of the linear fastener elements are effectively and securely engaged in mesh, the fixing thread is accommodated in the concave portion securely and the inverted portion effectively contributes to reduction in the size.

According to the fourth aspect of the invention, in addition to the effect of the first aspect, the coupling head, the convex portion and the inverted portion formed in the gap portion are specified to make a best use of the coupling head and the concave portion of the linear fastener element and thus accommodation of the fixing thread and reduction in the size of the element can be realized easily.

According to the fifth and sixth aspects of the invention, in addition to the effect of the first aspect, the gradients of the concave portion with respect to the coupling head and the inverted portion of the linear fastener element are specified thereby preventing the fixing thread from escaping to the side of the coupling head and accelerating reduction in the size of the inverted portion.

According to the seventh aspect of the invention, in addition to the effect of the first aspect, crack of the fastener chain is prevented by inserting the core thread into an inside of the linear fastener element so as to complete the linear fastener element which secures a robust and firm engagement of the fastener elements. As mentioned above, the effects that the present invention exerts are extremely remarkable.

DESCRIPTION OF THE PREFERRED EMBODIMENTS

Figure 1:
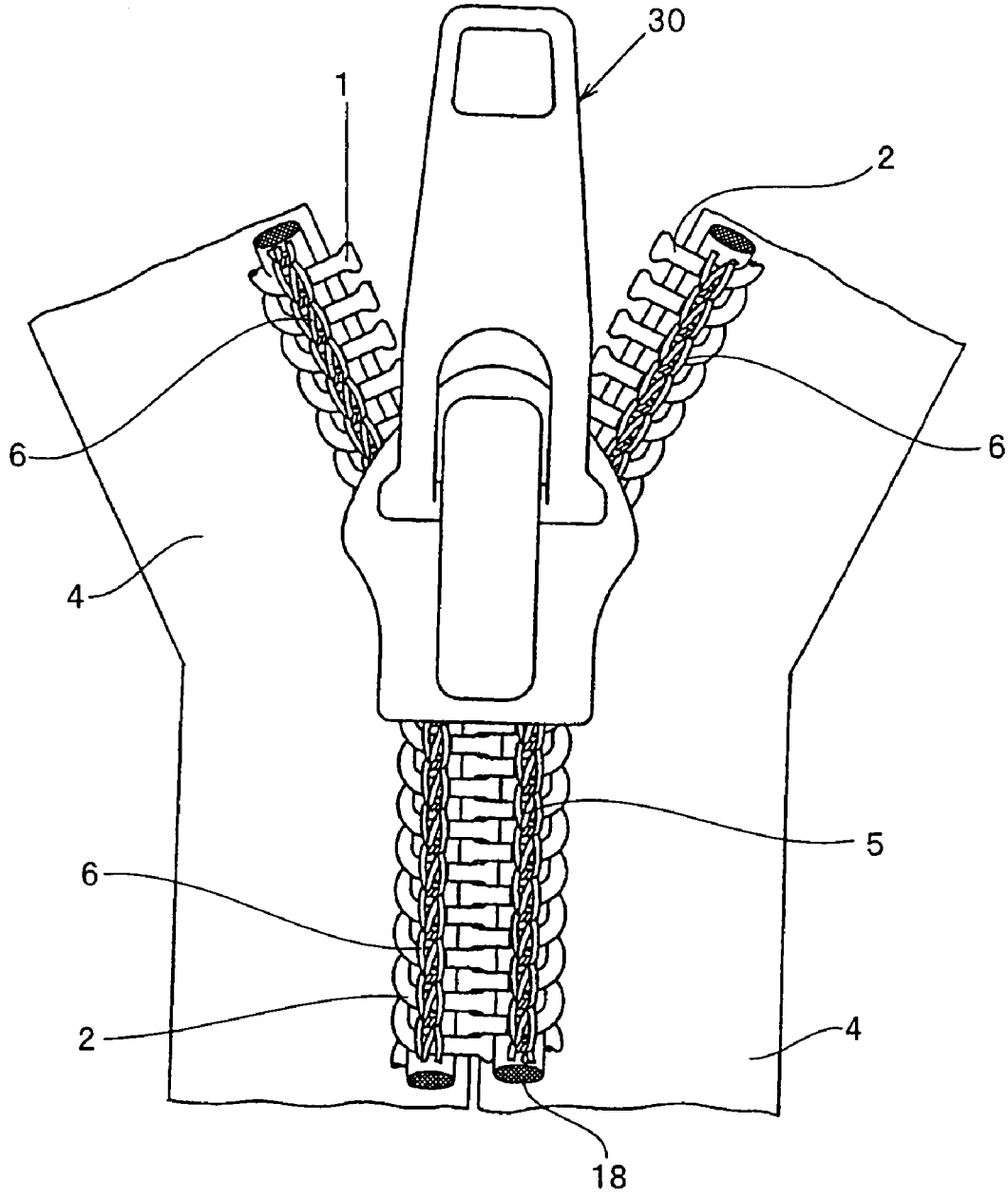
FIG. 1 is a front view of a linear slide fastener.

According to a linear slide fastener of the present invention, a linear fastener element 1 formed of thermoplastic resin monofilament is wound or bent into a coil-like fastener element 2 or a zigzag-like fastener element 3. The linear fastener element 1 is fixed to a side edge of a fastener tape 4 with a fixing thread 5, for example, a sewing thread 6, a woven thread 7 or a knitted thread 8.

Figure 2:
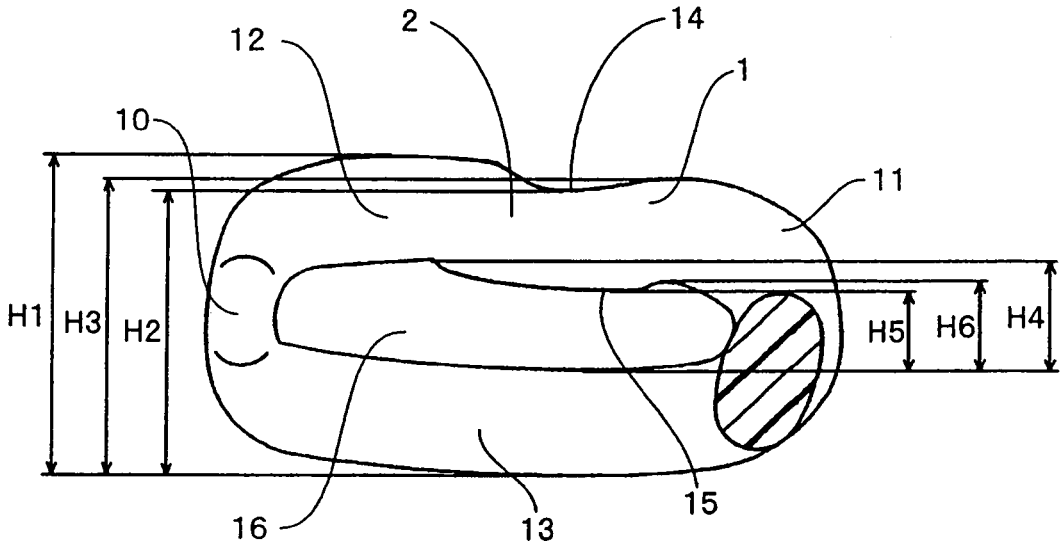
FIG. 2 is an explanatory diagram showing height dimension of each portion of the fastener element.
Figure 3:
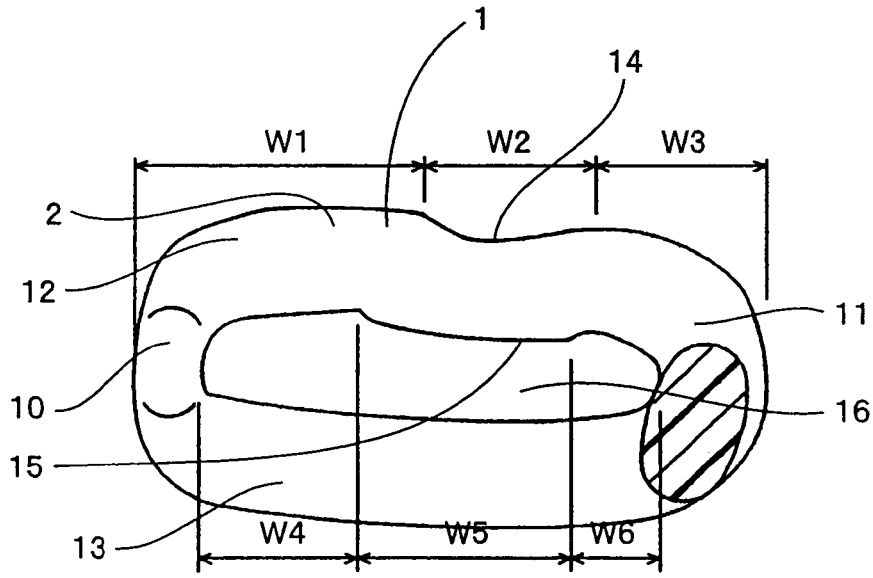
FIG. 3 is an explanatory diagram showing width dimension of each portion of the fastener element.
Figure 4:
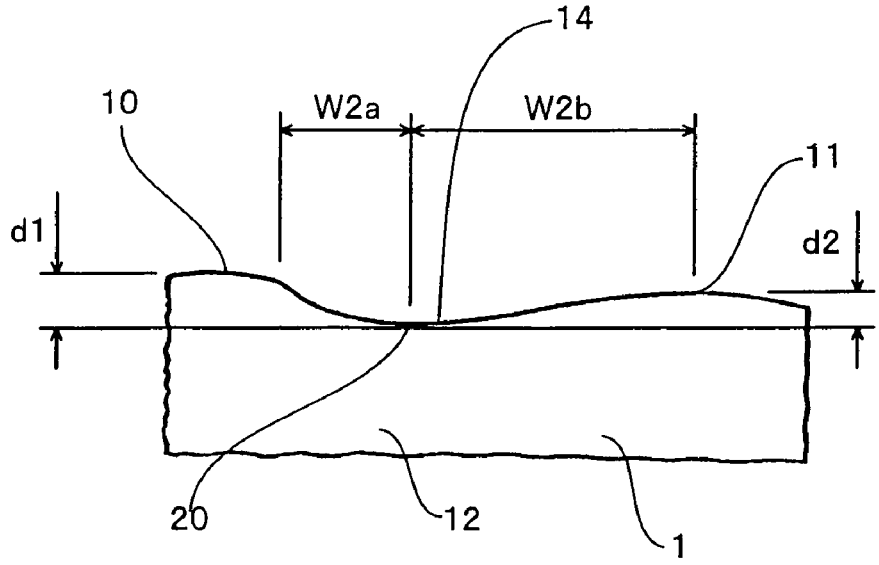
FIG. 4 is an explanatory diagram showing width and depth dimensions of a concave portion in the fastener element.

For example, as shown in FIGS. 2 to 4, in the coil-like fastener element 2, a concave portion 14 is formed on a top face of an upper leg portion 12 of the coil-like fastener element 2, and a convex portion 15 is formed on a bottom face of the upper leg portion 12 so as to project inward. When heights of the coil-like fastener element 2 on a side of the coupling head 10, at the concave portion 14 and on a side of an inverted portion 11 from a bottom face of a lower leg portion 13 of the coil-like fastener element 2 are assumed to be H1, H2 and H3 respectively and widths of the upper leg portion 12 on the side of the coupling head 10, at the concave portion 14 and on the side of the inverted portion 11 are assumed to be W1, W2 and W3 respectively, the linear fastener element 1 satisfies a setting condition of H1>H3>H2 and W1>W2≧W3.

Further, a convex portion 15 is formed on the bottom face of the upper leg portion 12 so as to project toward a top face of the lower leg portion 13. When dimensions between the bottom face of the upper leg portion 12 and the top face of the lower leg portion 13 on the side of the coupling head 10, at the convex portion 15 and on the side of the inverted portion 11 are assumed to be H4, H5 and H6 respectively, the setting condition is H4>H6>H5.

A gap portion 16 is formed between the upper leg portion 12 and the lower leg portion 13. When widths of the gap 16 on the side of the coupling head 10, at the convex portion 15 and on the side of the inverted portion 11 are assumed to be W4, W5 and W6 respectively, a setting condition of W5>W4>W6 is satisfied.

In other words, in the linear fastener element 1 of the present invention, the height on the side of the coupling head 10 is the largest followed by the inverted portion 11 and the concave portion 14. The width on the side of the coupling head 10 is the largest followed by the concave portion 14 and the inverted portion 11. As for the height of respective portions in the gap portion 16 of the linear fastener element 1, the height on the side of the coupling head 10 is the largest followed by the inverted portion 11 and the convex portion 15. As for the width of the respective portions in the gap portion 16, the width on the side of the convex portion 15 is the largest followed by the coupling head 10 and the inverted portion 11.

The gradient from the side of the coupling head 10 toward a deepest portion 20 of the concave portion 14 formed on the top face of the upper leg portion 12 is sharp while the gradient from the side of the inverted portion 11 toward the deepest portion 20 of the concave portion 14 is milder than the gradient from the side of the coupling head 10. Because the linear fastener element 1 of the present invention is formed in this way, it is capable of protecting a fixing thread 5 and the linear fastener element 1 or the inverted portion 11 can be reduced in size, whereby the linear fastener element 1 entirely being reduced in size.

First Embodiment

If the linear slide fastener of the present invention is explained, in the linear slide fastener of the first embodiment shown in FIGS. 1 to 7, its linear fastener element 1 is formed by winding monofilament of polyamide or polyester into coil. In the linear fastener element 1, as shown in FIGS. 2 to 6, the coupling head 10 is formed at an end while the inverted portion 11 is formed at the other end and these two portions are connected with the upper leg portion 12 and the lower leg portion 13 so as to form the coil-like fastener element 2. This coil-like fastener element 2 is sewed to a side edge of the fastener tape 4 with the sewing thread 6, for example, double ring sewing using two needles and three threads with a core thread 18 inserted through an interior of the coil-like fastener element 2.

In the coil-like fastener element 2, as shown in FIG. 2, when the height from the top face of the upper leg portion 12 to the bottom face of the lower leg portion 13 on the side of the coupling head 10 is assumed to be H1 and the height on the side of the inverted portion 11 is assumed to be H3, the concave portion 14 is capable of accommodating the sewing thread 6 by forming the concave portion 14 in a central portion of the upper leg portion 12 located therebetween while its height is assumed to be H2, and a setting condition is set to H1>H3>H2 in order to prevent the sewing thread 6 from escaping from the concave portion 14. As a specific example of the height, when the height H1 on the side of the coupling head 10 is in a range of 2.02 to 2.14, the height H3 on the side of the inverted portion 11 is in a range of 1.89 to 2.01 mm and the height H2 of the concave portion 14 is in a range of 1.81 to 1.93 mm.

When as shown in FIG. 3, the width from an outer end face of the coil-like fastener element 2 on the side of the coupling head 10 to the concave portion 14 is assumed to be W1, the width from the outer end face on the side of the inverted portion 11 to the concave portion 14 is assumed to be W3 and the width of the concave portion 14 formed in the central portion of the top face of the upper leg portion 12 is assumed to be W2, the setting condition is set to W1>W2≧W3 for the coil-like fastener element 2 to achieve a firm engagement, accommodation of the fixing thread 5 and a small size thereof. As a specific example of the width, when the entire width of the coil-like fastener element 2 from the outer end face of the coupling head 10 to the outer end face of the inverted portion 11 is in a range of 3.97 to 4.09 mm, the width W2 of the concave portion is in a range of 1.04 to 1.16 mm and the width W1 on the side of the coupling head 10 is larger than the width W2 and the width W3 on the side of the inverted portion 11 is smaller than the width W2.

As for the relation between the width W3 on this side of the inverted portion 11 and the width W2 of the concave portion 14, the width W2 of the concave portion 14 is set equal or larger than the width W3 on the side of the inverted portion 11 and a sum of the width W2 on the side of this concave portion 14 and the width W3 of the inverted portion 11 is set larger than the width W1 on the side of the coupling head 10 in order to form the inverted portion 11 of the coil-like fastener element 2 as small as possible whereby reducing the size of the coil-like fastener element 2.

When the convex portion 15 projecting into the gap portion 16 toward the lower leg portion 13 is formed on the bottom face of the upper leg portion 12 of the coil-like fastener element 2 and the height from the bottom face of the upper leg portion 12 to the top face of the lower leg portion 13 on the side of the coupling head 10 in this gap portion 16 is assumed to be H4, the height on the side of the inverted portion 11 is assumed to be H6 and the height at the convex portion 15 is assumed to be H5 and further when the width from an inside end face of the coupling head 10 to the convex portion 15 in the gap portion 16 is assumed to be W4, the width form an inside end face of the inverted portion 11 to the convex portion 15 is assumed to be W6 and the width of the convex portion 15 is assumed to be W5, a setting condition of H4>H6>H5 and W5>W4>W6 is satisfied to make it possible to form the coil-like fastener element 2 entirely in a smaller size.

The gradient in the concave portion 14 formed on the top face of the upper leg portion 12 of the coil-like fastener element 2 as shown in FIG. 4 will be described. The gradient of the concave portion 14 from an end thereof to the deepest portion 20 of the concave portion 14 on the side of the coupling head 10 is sharper than the gradient on the side of the inverted portion 11. The inverted portion 11 provides a mild gradient from the end thereof to the deepest portion 20. Forming the concave portion 14 on the side of the coupling head 10 into a steep slope directing toward the deepest portion 20 of the concave portion 14 allows the fixing thread 5 located on the side of the coupling head 10 to slide positively into the concave portion 14, thereby preventing the fixing thread 5 accommodated in the concave portion 14 from moving freely to the side of the coupling head 10 and escaping from the concave portion 14 to secure a smooth sliding of a slider. Further, forming the concave portion 14 on the side of the inverted portion 11 into a mild slope toward the deepest portion 20 of the concave portion 14 secures the width W2 of the concave portion 14 large thereby accommodating the fixing thread 5 securely within the concave portion 14 and preventing the fixing thread 5 from moving from the concave portion 14 to the side of the inverted portion 11.

As regards this gradient, the width of the concave portion 14 is formed so that a width W2*a* on the side of the coupling head 10 is in a steep slope having a sharp gradient and a width W2*b* on the side of the inverted portion 11 is in a mild slope having a mild gradient toward the deepest portion 20 of the concave portion 14. Further, as regards the depth of the concave portion 14, if a depth on the side on the coupling head 10 with respect to the deepest portion 20 of the concave portion 14 is assumed to be d1 while a depth on the side of the inverted portion 11 is assumed to be d2, the concave portion 14 has a relation of W2*a*<W2*b* and d2<d1. As a specific example of the depth, when the depth d1 on the side of the coupling head 10 is 0.15 to 0.27 mm, the depth d2 on the side of the inverted portion 11 is 0.02 to 0.14 mm.

Figure 5:
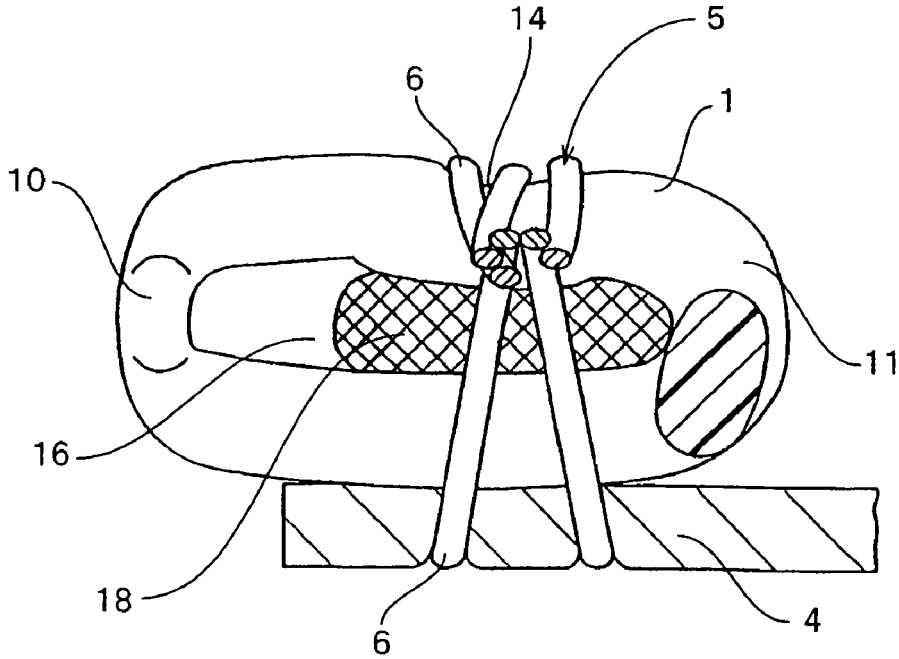
FIG. 5 is a longitudinal sectional view of the fastener stringer.
Figure 6:
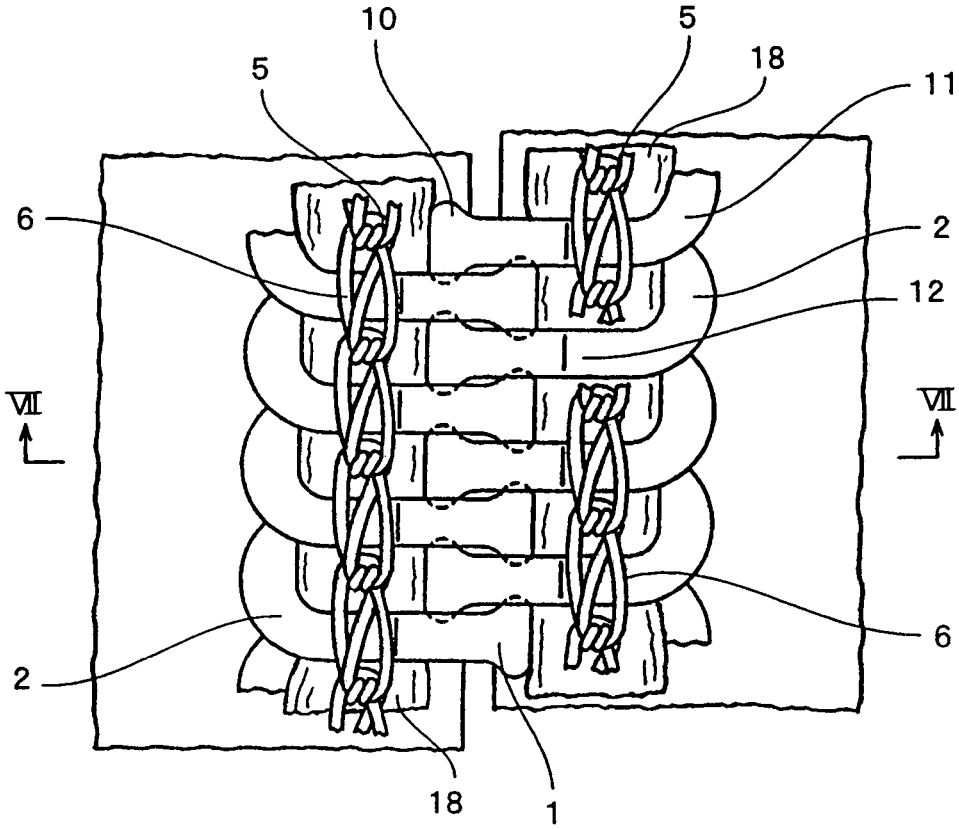
FIG. 6 is a partial front view of a linear slide fastener.
Figure 7:
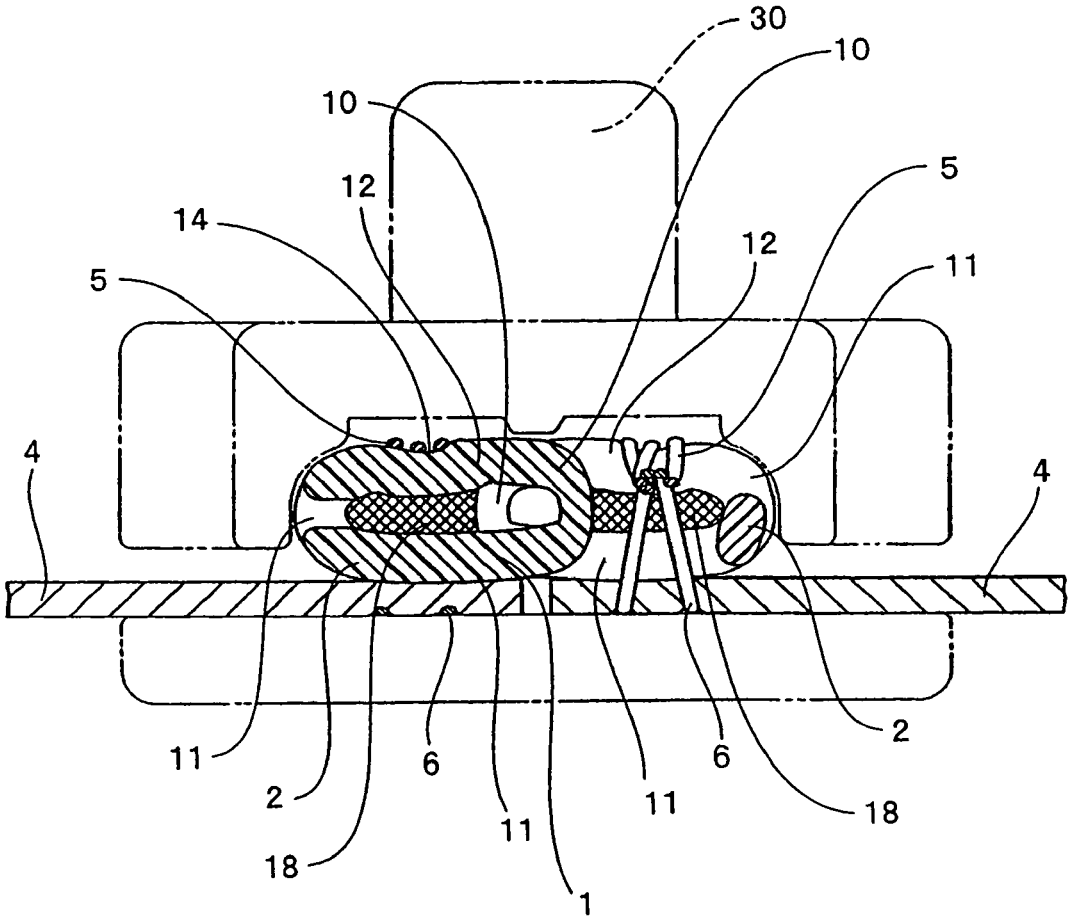
FIG. 7 is a sectional view taken along a line VII-VII of FIG. 6.

In the fastener stringer shown in FIG. 5 and the linear slide fastener shown in FIGS. 6 and 7, the core thread 18 is inserted into an inside of the coil-like fastener element 2 and specifically, the core thread 18 is inserted between the convex portion 15 and the inverted portion 11 in the gap portion 16 between the upper leg portion 12 and the lower leg portion 13, such that the core thread 18 is brought into contact with the convex portion 15 and the top face of the lower leg portion 13 opposing this convex portion 15 and further the bottom face of the upper leg portion 12 and the top face of the lower leg portion 13 on the side of the inverted portion 11 and an inside end face of the inverted portion 11. The lower leg portion 13, which is flat, of this coil-like fastener element 2 is placed on a side edge of the fastener tape 4 and the core thread 18 and the coil-like fastener element 2 are attached by sewing with the sewing thread 6 for double ring sewing with two needles and three threads. At this time, the fixing thread 5 of the sewing thread 6 is accommodated within the concave portion 14 formed in the upper leg portion 12 of the coil-like fastener element 2 and prevented from moving from the concave portion 14 to the side of the coupling head 10 and escaping from there. Because the sewing thread 6 is never moved from the concave portion 14 as described before, the core thread 18 fixed to the fastener tape 4 with the same sewing thread 6 is never moved into the gap portion 16 on the side of the coupling head 10.

Further, the fixing thread 5 can be protected from being worn by sliding motion of a slider 30 because it is accommodated within the concave portion 14 and because the inverted portion 11 of the coil-like fastener element 2 can be formed in a small size, the coil-like fastener element 2 entirely can be formed in a smaller size than a conventional product. Further, the core thread 18 inserted through the inside of the coil-like fastener element 2 comes into contact with an outer end face of a coupling head 10 of a mating coil-like fastener element 2 so that it presses that coil-like fastener element 2 to intensify the engagement of the fastener elements.

Second Embodiment

Figure 8:
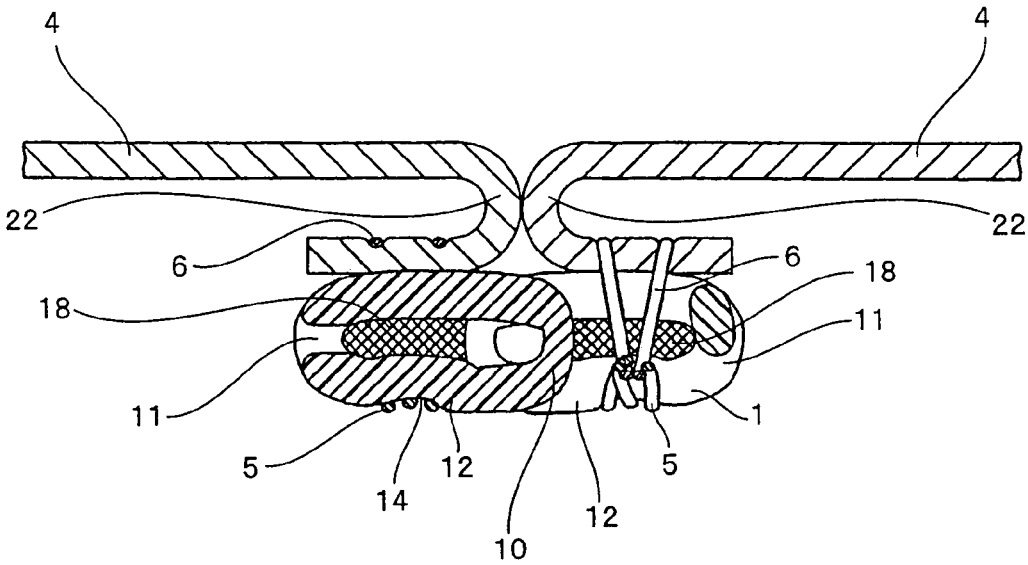
FIG. 8 is a sectional view of a hidden type slide fastener of a second embodiment.

A linear slide fastener according to a second embodiment of the invention shown in FIG. 8 is a hidden type slide fastener with a folded portion 22 on a side edge of the fastener tape 4, wherein right and left folded portions 22 are butted each other and the upper leg portion 12 having a same setting condition as the above-mentioned coil-like fastener element 2 is sewed and fixed with the sewing thread 6 for double ring sewing as the fixing thread 5 through the concave portion 14. In this case, the concave portion 14 is formed in the leg portion disposed outside. This hidden type slide fastener has the same setting condition as the above-described example, so that the fixing thread 5 is accommodated in the concave portion 14 formed in the upper leg portion 12, thereby being prevented from moving and escaping from the side of the coupling head 10. The inverted portion 11 at an end of the coil-like fastener element 2 can be formed in a small size, so that the coil-like fastener element 2 entirely can be reduced into a smaller size than the conventional slide fastener, thereby resulting in saving of resources.

Third Embodiment

Figure 9:
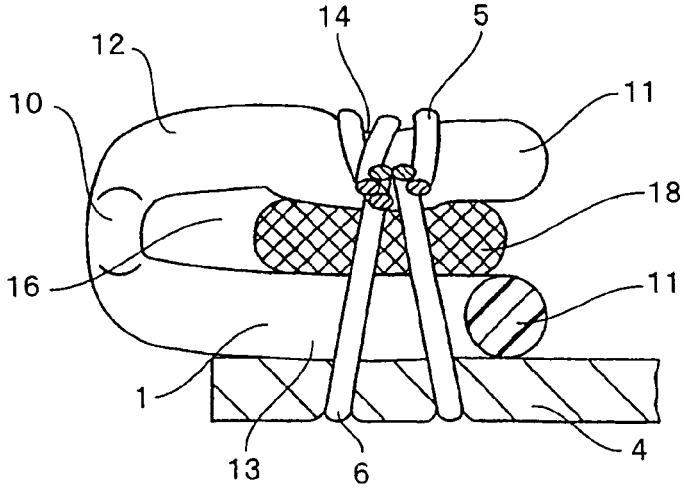
FIG. 9 is sectional view of a fastener stringer having a zigzag-like fastener element of a third embodiment.

A linear slide fastener according to a third embodiment of the invention shown in FIG. 9 is a linear slide fastener produced by fixing a zigzag-like fastener element 3 on a side edge of the fastener tape 4 by sewing with the sewing thread 6 for double ring sewing as the fixing thread 5. The zigzag-like fastener element 2 is provided with the same various setting conditions as those of the above-described example and the upper leg portion 12 on the side of the coupling head 10 is formed with a sharp gradient while that on the side of the inverted portion 11 is formed with a mild gradient. The core thread 18 is inserted between the upper leg portion 12 and the lower leg portion 13 of this zigzag-like fastener element 3 and the concave portion 14 formed in the upper leg portion 12 is fixed by sewing with the sewing thread 6 for double ring sewing as the fixing thread 5.

The linear fastener element 1 of this embodiment is provided with the same setting condition as those described previously, whereby the concave portion 14 prevents the fixing thread 5 from moving and escaping to the side of the coupling head 10 of the zigzag-like fastener element 3 and the fixing thread 5 from being worn by a sliding motion of the slider. Consequently, the inverted portion 11 of the zigzag-like fastener element 3 can be formed in a small size so that the zigzag-like fastener element 3 entirely can be reduced in a smaller size than the conventional product, thereby resulting in saving of resources.

Fourth Embodiment

Figure 10:
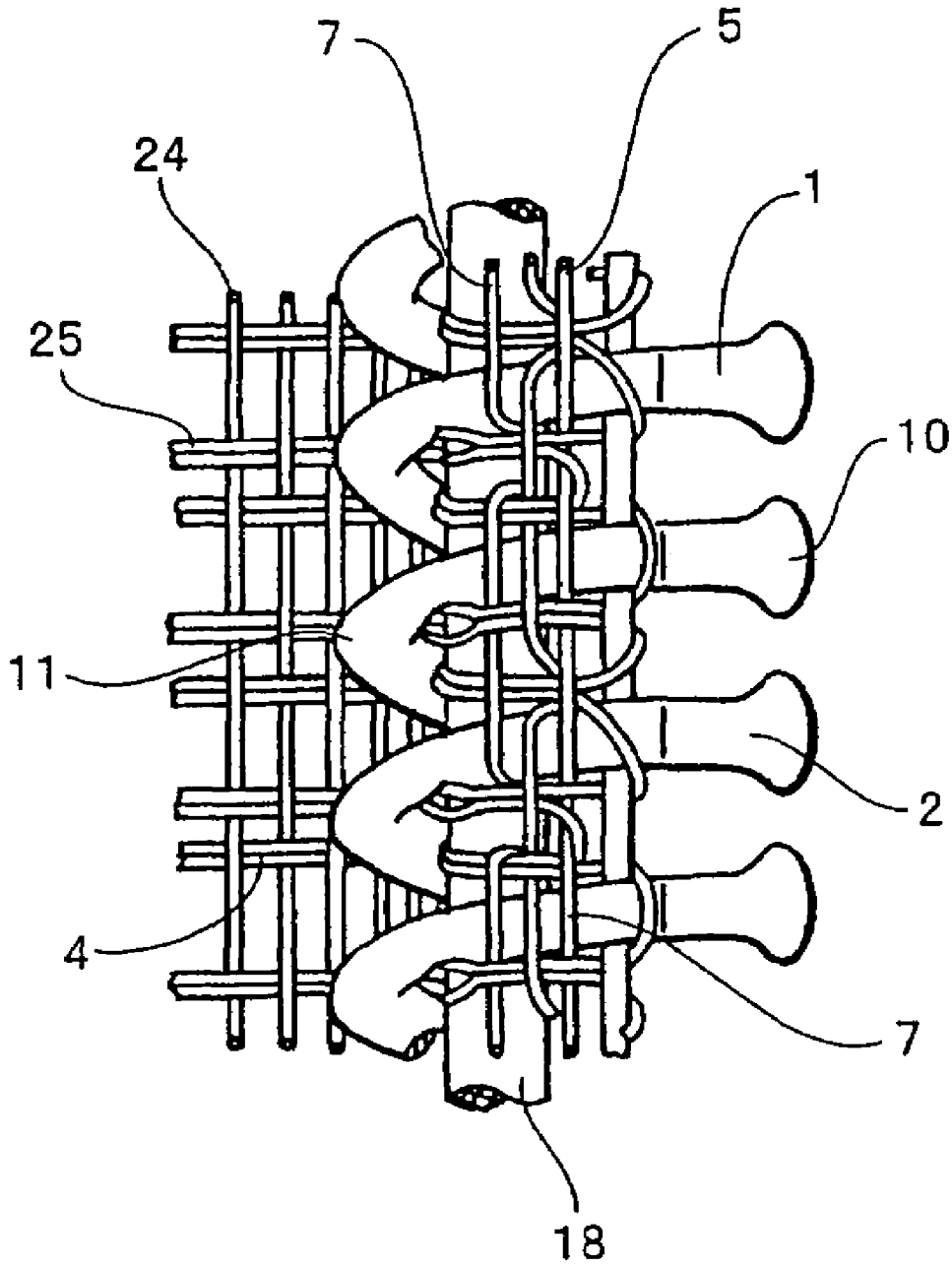
FIG. 10 is a partial front view of a woven type slide fastener of a fourth embodiment.

A linear slide fastener according to a fourth embodiment of the invention shown in FIG. 10 is produced by weaving the coil-like fastener elements 2 into the fastener tape 4 at the same time when the fastener tape 4 is woven. The coil-like fastener element 2 has the same setting condition as the above-described example and the core thread 18 is inserted through the inside of this coil-like fastener element 2 and the coil-like fastener element 2 is woven in with warp 24 and double-pick weft 25. As a consequence, a top portion of the coil-like fastener element 2 is fixed by weaving in with the double-pick weft 25 and the woven thread 7 as the fixing thread 5.

This coil-like fastener element 2 has the same setting condition as the above-described example, so that the coil-like fastener element 2 prevents the woven thread 7 as the fixing thread 5 form moving or escaping from the concave portion 14. Further, the inverted portion 11 of the coil-like fastener element 2 can be formed in a small size, so that the coil-like fastener element 2 entirely can be reduced in a smaller size than a conventional product, thereby resulting in saving of resources.

Fifth Embodiment

Figure 11:
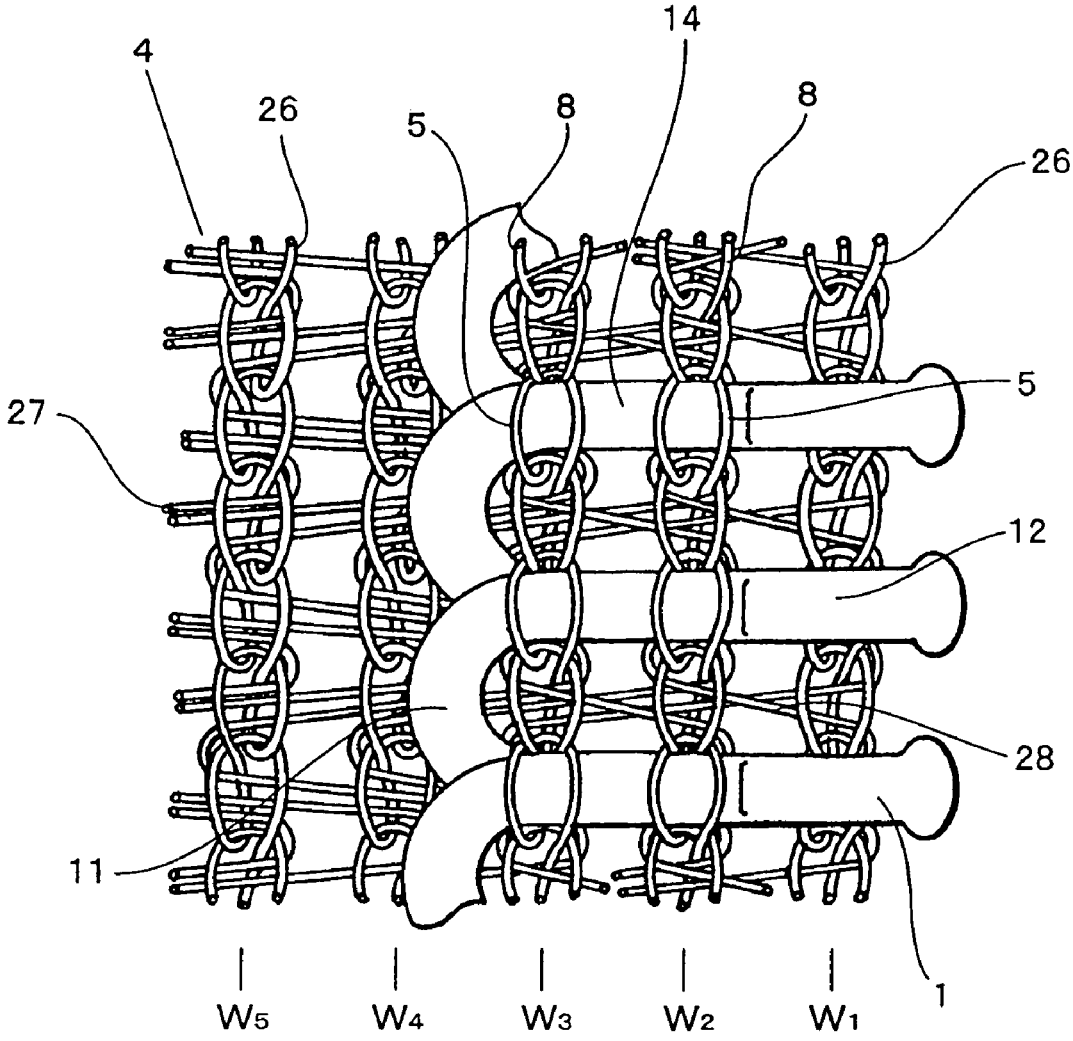
FIG. 11 is a partial front view of a knitted type slide fastener of a fifth embodiment.
Figure 12:
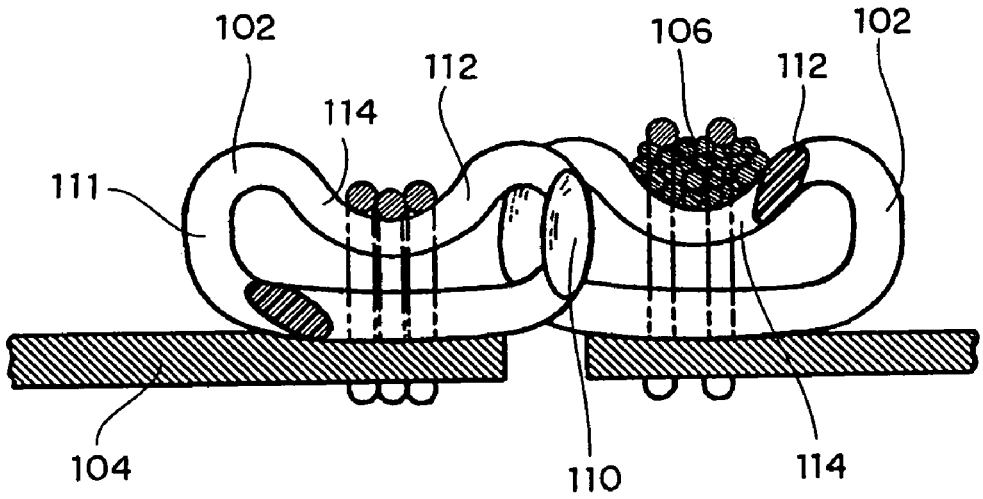
FIG. 12 PRIOR ART
FIG. 12 is a sectional view of a well-known linear slide fastener.

In a linear slide fastener according to a fifth embodiment of the invention shown in FIG. 11, its coil-like fastener element 2 is provided with the same setting condition as the above-described example and the concave portion 14 is formed in the upper leg portion 12 and the inverted portion 11 is formed in a small size. The coil-like fastener element 2 is woven in with the warp knitting yarn 8 or knitting yarn of chain knitting structure in this case as the fixing thread 5. The fastener tape 4 is produced by knitting with warp knitting structure and for example, chain knitting yarn 26 of 1-0/0-1 and weft insertion yarn 27 of 0-0/3-3 are disposed on all wales such that they are entangled with each other. Weft insertion yarn 28 of 2-2/0-0 is disposed on W1 to W3 such that it is entangled with the weft insertion yarn 27 so as to fix the coil-like fastener element 2 by tightening. The concave portion 14 in the upper leg portion 12 of the coil-like fastener element 2 is tightened with the warp knitting yarn 8 of the chain knitting structure of W2 and W3 so that the warp knitting yarn 8 is prevented from moving or escaping from the concave portion 14 in the upper leg portion 12. In the meantime, the warp knitting yarn 8 is not restricted to the aforementioned knitting yarn but for example, it is permissible to knit the fastener tape 4 by disposing tricot knitting yarn of 1-2/1-0 or two needle stitch knitting yarn of 0-2/2-0 on all wales.

The linear slide fastener of the present invention may be used at an opening of products using all kinds of slide fasteners instead of those slide fasteners.

What is claimed is:

1. A linear slide fastener in which a linear fastener element fixed to a side edge of a fastener tape with a fixing thread, wherein a concave portion for accommodating the fixing thread is formed on a top face of an upper leg portion of the linear fastener element, and when heights from a bottom face of a lower leg portion up to the top face of the upper leg portion on a side of a coupling head, at the concave portion and on a side of an inverted portion are assumed to be H1, H2 and H3 respectively, a condition of H1>H3>H2 is provided, a convex portion projecting toward a top face of the lower leg portion is formed on a bottom face of the upper leg portion, when heights from the bottom face of the upper leg portion to the top face of the lower leg portion on the side of the coupling head and at the convex portion are assumed to be H4 and H5 respectively, a condition of H4>H5 is provided, and wherein a width from an end of the concave portion on the side of the coupling head to a deepest portion of the concave portion formed on the top face of the upper leg portion is smaller than a width from an end of the concave portion on the side of the inverted portion to the deepest portion of the concave portion, wherein a core thread is inserted through the convex portion and the side of the inverted portion in a gap portion formed between the upper leg portion and the lower leg portion of the linear fastener element, and wherein a gradient of slope from an end of the concave portion on the side of coupling head to the deepest portion of the concave portion formed on the top face of the upper leg portion is sharper than a gradient of slope from an end of the of the concave portion on the side of the inverted portion to the deepest portion of the concave portion.

2. The linear slide fastener according to claim 1, wherein, when widths of the top face of the upper leg portion of the linear fastener element on the side of the coupling head, at the concave portion and on the side of the inverted portion are assumed to be W1, W2 and W3 respectively, a condition of W1>W2≧W3 is provided.

3. The linear slide fastener according to claim 1, wherein, when widths on the side of the coupling head, at the convex portion and on the side of the inverted portion in a gap portion between the upper leg portion and the lower leg portion of the linear fastener element are assumed to be W4, W5 and W6 respectively, a condition of W5>W4>W6 is provided.

4. The linear slide fastener according to claim 1, wherein a depth of the concave portion from an end thereof on the side of the coupling head to a deepest portion of the concave portion formed on the top face of the upper leg portion is larger than a depth of the concave portion from an end thereof on the side of the inverted portion to the deepest portion of the concave portion.

5. A linear slide fastener in which a linear fastener element fixed to a side edge of a fastener tape with a fixing thread, wherein a concave portion for accommodating the fixing thread is formed on a top face of an upper leg portion of the linear fastener element, and when heights from a bottom face of a lower leg portion up to the top face of the upper leg portion on a side of a coupling head, at the concave portion and on a side of an inverted portion are assumed to be H1, H2 and H3 respectively, a condition H1>H3>H2 is provided, a convex portion projecting toward a top face of the lower leg portion is formed on a bottom face of the upper leg portion, when heights from the bottom face of the upper leg portion to the top face of the lower leg portion on the side of the coupling head and at the convex portion are assumed to be H4 and H5 respectively, a condition of H4>H5 is provided, and wherein a width from an end of the concave portion on the side of the coupling head to a deepest portion of the concave portion formed on the top face of the upper leg portion is smaller than a width from an end of the concave portion on the side of the inverted portion to the deepest portion of the concave portion, and wherein a gradient of slope from an end of the concave portion on the side of coupling head to the deepest portion of the concave portion formed on the top face of the upper leg portion is sharper than a gradient of slope from an end of the of the concave portion on the side of the inverted portion to the deepest portion of the concave portion.

* * * * *

UNITED STATES PATENT AND TRADEMARK OFFICE

CERTIFICATE OF CORRECTION

PATENT NO. : 7,520,032 B2
APPLICATION NO. : 11/373741
DATED : April 21, 2009
INVENTOR(S) : Kousaka et al.

It is certified that error appears in the above-identified patent and that said Letters Patent is hereby corrected as shown below:

Column 2,

Line 64, "≧" should read --≥--.

Column 4,

Line 62, "≧" should read --≥--.

Column 6,

Line 6, "≧" should read --≥--.

Column 10,

Line 9, "≧" should read --≥--.

Signed and Sealed this

Thirtieth Day of June, 2009

JOHN DOLL
*Acting Director of the United States Patent and Trademark Office*